US009547262B2

(12) United States Patent
Hirayama et al.

(10) Patent No.: US 9,547,262 B2
(45) Date of Patent: Jan. 17, 2017

(54) FIXING DEVICE WITH RECEIVING PORTION CONFIGURED TO RECEIVE INFORMATION CORRESPONDING TO WIDTH OF RECORDING MATERIAL FROM EXTERNAL TERMINAL AND IMAGE FORMING APPARATUS INCLUDING SUCH FIXING DEVICE

(71) Applicant: CANON KABUSHIKI KAISHA, Tokyo (JP)

(72) Inventors: Taiya Hirayama, Moriya (JP); Kenichi Tanaka, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/721,344

(22) Filed: May 26, 2015

(65) Prior Publication Data

US 2015/0346655 A1 Dec. 3, 2015

(30) Foreign Application Priority Data

May 29, 2014 (JP) ..... 2014-111045
Apr. 3, 2015 (JP) ..... 2015-076665

(51) Int. Cl.
*G03G 15/20* (2006.01)
*G03G 15/16* (2006.01)
*G03G 21/16* (2006.01)

(52) U.S. Cl.
CPC ..... *G03G 15/2039* (2013.01); *G03G 21/1685* (2013.01)

(58) Field of Classification Search
CPC ..... G03G 21/1685; G03G 21/1657; G03G 21/1642; G03G 15/2039; G03G 15/2017
USPC ..... 399/122, 33, 12, 13, 23, 14
See application file for complete search history.

(56) References Cited

U.S. PATENT DOCUMENTS

| | | | | |
|---|---|---|---|---|
| 7,262,391 | B2 | 8/2007 | Nishihara et al. | |
| 7,890,024 | B2 | 2/2011 | Hirayama et al. | |
| 7,890,038 | B2 | 2/2011 | Chikugo et al. | |
| 8,655,242 | B2 | 2/2014 | Tanaka | |
| 8,942,612 | B2 | 1/2015 | Tanaka | |
| 9,069,299 | B2 | 6/2015 | Tanaka | |
| 2004/0240893 | A1 * | 12/2004 | Sato | G03G 15/5075 399/8 |

(Continued)

FOREIGN PATENT DOCUMENTS

| | | |
|---|---|---|
| JP | 2008-040365 | 2/2008 |
| JP | 2011-56945 A | 3/2011 |
| JP | 2012-234016 A | 11/2012 |

OTHER PUBLICATIONS

Shutaro Saito et al., U.S. Appl. No. 14/721,206, filed May 26, 2015.

(Continued)

*Primary Examiner* — Billy Lactaoen
(74) *Attorney, Agent, or Firm* — Fitzpatrick, Cella, Harper & Scinto

(57) ABSTRACT

A fixing device detachably mountable to an image forming apparatus, includes: a pair of rotatable members forming a nip configured to fix a toner image on a recording material by heat and pressure; a receiving portion capable of receiving information corresponding to the width of a recording material from an external terminal so as to limit a use of the fixing device; and a storing portion configured to store the information received by the receiving portion.

31 Claims, 9 Drawing Sheets

(56) References Cited

U.S. PATENT DOCUMENTS

| | | | | |
|---|---|---|---|---|
| 2006/0029399 | A1* | 2/2006 | Park | G03G 21/1882 399/12 |
| 2006/0198642 | A1* | 9/2006 | Bischel | G03G 15/2064 399/12 |
| 2011/0058201 | A1 | 3/2011 | Mueller | |
| 2013/0100467 | A1* | 4/2013 | Miyazaki | H04N 1/00015 358/1.9 |
| 2015/0185670 | A1 | 7/2015 | Tanaka | |

OTHER PUBLICATIONS

Kenichi Tanaka et al., U.S. Appl. No. 14/722,279, filed May 27, 2015.

Kenichi Tanaka et al., U.S. Appl. No. 14/722,503, filed May 27, 2015.

* cited by examiner

FIXING DEVICE WITH RECEIVING PORTION CONFIGURED TO RECEIVE INFORMATION CORRESPONDING TO WIDTH OF RECORDING MATERIAL FROM EXTERNAL TERMINAL AND IMAGE FORMING APPARATUS INCLUDING SUCH FIXING DEVICE

FIELD OF THE INVENTION AND RELATED ART

The present invention relates to a fixing device and an image forming apparatus. This fixing device is usable in, e.g., a copying machine, a printer, a facsimile machine and a multi-function machine having a plurality of functions of these machines.

In a conventional image forming apparatus of an electrophotographic type, a fixing device for fixing a toner image formed on a recording material by using an electrophotographic process is mounted. This fixing device has a constitution in which the toner image is heated while nipping and feeding the recording material at a nip formed by a pair of rotatable members, e.g., a fixing roller and a pressing roller.

The state of a surface of the fixing roller has an influence on the glossiness of an image, and therefore it has become important more than ever that the surface property of the fixing roller is stably maintained. However, when a side edge of the recording material continuously contacts the fixing roller at the same position, there is a tendency for the surface property at a portion thereof (contact portion) is inferior to that at another portion.

It would be considered that this is because the side edge of the recording material has a minutely bent (flexed) shape during the manufacturing thereof, i.e., during cutting.

In such a background, when recording materials having the same width are continuously introduced into the fixing device, fixing roller portions contacting both side edges of the recording materials are damaged (also referred to as fixing device).

In such a state that the edge damage is generated on the fixing roller surface, when the image is formed on a recording material wider than the above recording materials, there is a risk that the glossiness of the image at a portion corresponding to the edge damage is lowered compared with that at another portion, and thus uneven glossiness is generated on the image.

Therefore, in an apparatus (device) described in Japanese Laid-Open Patent Application (JP-A) 2008-040365, the generation of uneven glossiness on the image is suppressed by rubbing the fixing roller surface with a roughening roller to level out the surface property of the fixing roller with respect to a longitudinal direction of the fixing roller, and therefore this method is an excellent method that is satisfactory for a general user.

However, in the method described in JP-A 2008-040365, it is difficult to completely eliminate the uneven glossiness of the image, and in the case where the required level by the user with respect to uniformity of the glossiness of the image is very high, it is difficult to deal with the uneven glossiness by using such a method.

SUMMARY OF THE INVENTION

According to an aspect of the present invention, there is provided a fixing device detachably mountable to an image forming apparatus, comprising: a pair of rotatable members forming a nip configured to fix a toner image on a recording material by heat and pressure; a receiving portion capable of receiving information corresponding to a width of a recording material from an external terminal so as to limit a use of the fixing device; and a storing portion configured to store the information received by the receiving portion.

According to another aspect of the present invention, there is provided an image forming apparatus comprising: an image forming device configured to form a toner image on a recording material; and a fixing device configured to fix the toner image, formed by the image forming device, on the recording material. The fixing device includes a receiving portion capable of receiving information corresponding to a width of the recording material from an external terminal and includes a storing portion configured to store the information received by the receiving portion. The image forming apparatus also includes: a reading portion configured to read the information stored in the storing portion; an obtaining portion configured to obtain information of the width of a recording material to be subjected to image formation; and a controller configured to control whether or not an image forming operation should be prohibited the basis of the information read by the reading portion and the information obtained by the obtaining portion.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments of the present invention will be described, but although the following embodiments are examples of preferred embodiments, the present invention is not limited to the following embodiments.

Embodiment 1

General Structure of Image Forming Apparatus

Figure 2:
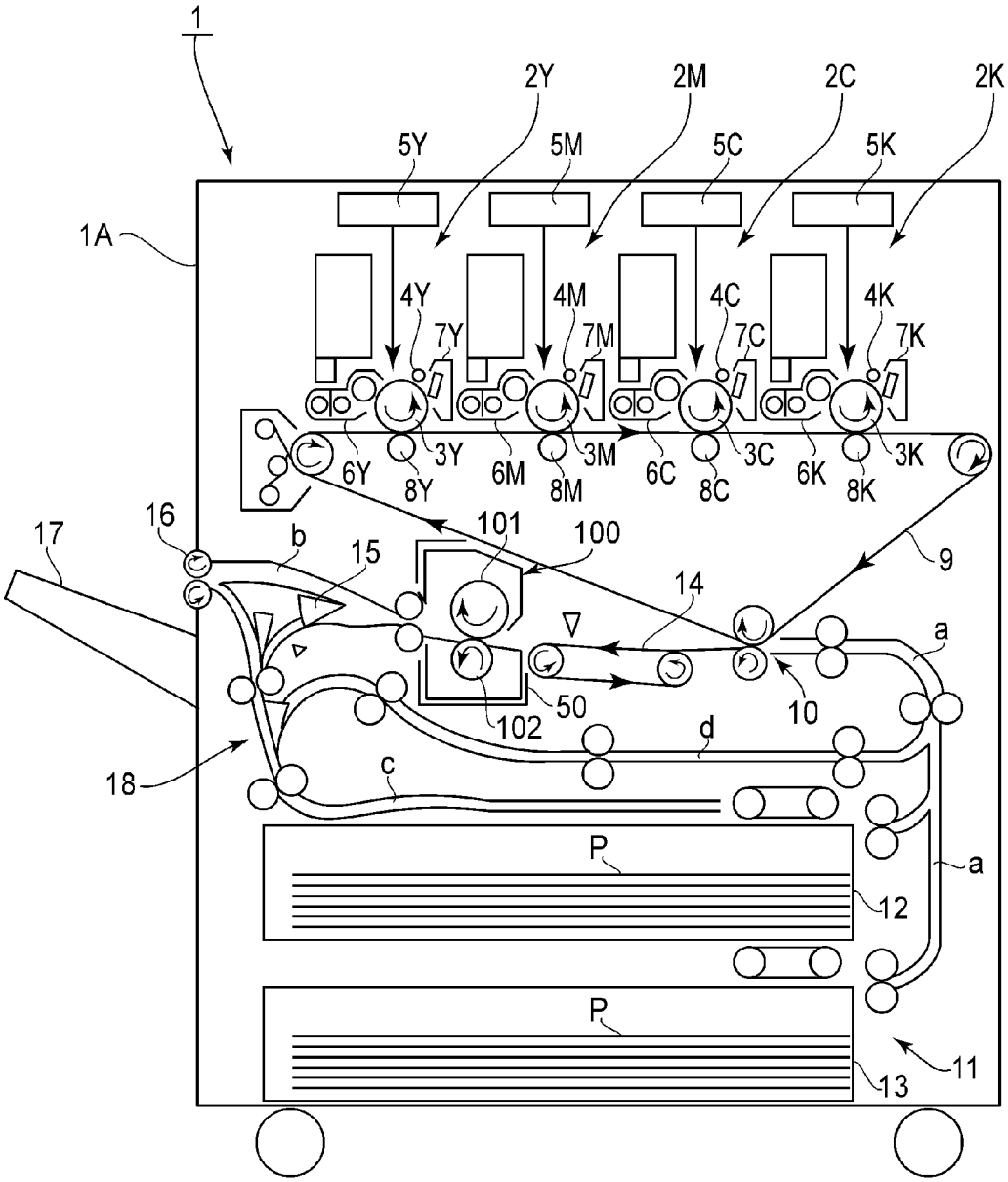
FIG. 2 is a schematic view showing a structure of the image forming apparatus.

FIG. 2 is a schematic view showing a general structure of an image forming apparatus 1 in this embodiment. This image forming apparatus 1 is an electrophotographic full-color printer which is of an intermediary transfer type and which has a both-side image forming function. Inside an apparatus main assembly (image forming apparatus main assembly) 1A of the image forming apparatus 1, e.g., four image forming portions 2Y, 2M, 2C and 2K corresponding to Y (yellow), M (magenta), C (cyan) and K (black), respectively, are disposed in series as an image forming means. That is, as the image forming device, a tandem type is employed in which a process is performed in parallel among the respective colors of Y, M, C and K until a visible image is formed.

In order to avoid a cumbersome description, the four image forming portions 2Y, 2M, 2C, and 2K, for the respective colors of Y, M, C and K, will be described by representing these portions with the reference numeral "2", and this schema of using a reference numeral instead of a reference numeral and a letter is similarly applied to the following associated process means, such as the photosensitive members 3Y, 3M, 3C, and 3K, the primary chargers 4Y 4M, 4C, and 4K, the exposure devices 5Y, 5M, 5C, and 5K, the developing devices 6Y, 6M, 6C, and 6K, and the cleaning device 7Y, 7M, 7C and 7K so that these devices are respectively referred to with reference numerals 3, 4, 5, 6, and 7. Further, the order of arrangement of the image forming portions 2 for the respective colors of Y, M, C and K is not limited to the above order.

At each of the image forming portions 2, the following respective electrophotographic process means are provided. That is, a photosensitive member (image bearing member) 3 for bearing an electrostatic latent image on a surface thereof corresponding to an associated one of the colors of Y, M, C and K, a primary charger 4, an exposure device 5, a developing device 6 and a cleaning device 7 are provided.

The primary charger 4 electrically charges the surface of an associated photosensitive member 3 uniformly by applying a charging bias voltage having a set potential. The surface of the photosensitive member 3 is exposed to light by the exposure device 5 corresponding to an image information pattern, so that the electrostatic latent image is formed. The electrostatic latent image is developed with a toner (developer) by the developing device 6, thus being changed into a visible image as a toner image.

Toner images of the respective colors of Y, M, C and K, which are formed and carried on the surfaces of the photosensitive members 3 of the respective image forming portions 2, are successively primary-transferred superposedly onto an endless belt as an intermediary transfer member 9 by a primary transfer device 8. A primary transfer residual toner on each of the photosensitive members 3 is removed by the cleaning device 7.

An unfixed full-color toner image formed on the intermediary transfer member 9 by superposing the toner images of all the colors of Y, M, C and K is collectively secondary-transferred by a secondary transfer device 10 onto a recording material P as a recording medium fed from a feeding portion 11 to the secondary transfer device 10.

The recording material (hereinafter referred to as a sheet) P is an image formable sheet-like member and may include plain paper, glossy paper, a resin-made sheet such as an OHP sheet, thick paper, an envelope, a postcard, a label or the like. In the image forming apparatus 1 in this embodiment, the feeding portion 11 includes sheet cassettes 12 and 13 as upper and lower cassette portions, each accommodating sheets P. Further, a feeding member for the sheet cassette accommodating sheets P, having a width selected and designated in advance, is driven, so that one of the sheets P in the cassette is separated and fed to the secondary transfer device 10 through a feeding path a.

The width of the sheet P is a sheet dimension with respect to a direction perpendicular to a sheet feeding direction X (FIG. 1) on a sheet surface. In the image forming apparatus 1 in this embodiment, independently of the width of the sheet P, the sheet P is introduced into a fixing device (fixing unit) 100 so that a center position of the sheet P with respect to a width direction of the sheet P substantially coincides with a center position of the fixing device 100 with respect to the width direction of the fixing device 100.

The sheet P that has passed through the secondary transfer device 10 is separated from the intermediary transfer member 9 and is guided by a feeding device 14 into the fixing device 100 functioning as an image heating apparatus. The fixing device 100 applies heat and pressure to the unfixed toner image while nipping and feeding the sheet P, thus fixing the toner image as a fixed image as described later.

In the case of a one-side image forming mode, the sheet P coming out of the fixing device 100 is changed in course to a feeding path b side by a flag 15, and is discharged, as a full-color image-formed product (resultant product) on which the image is formed on one surface thereof, onto a discharging tray 17.

In the case of a double-side image forming mode, the sheet P which comes out of the fixing device 100 and on which the image has already been formed on a first surface is changed in course to a double-side feeding path mechanism 18 side by the flag 15. Then, the sheet P is fed in a switch-back manner after being fed into a feeding path c of the mechanism 18, and is fed again into the feeding path a via a feeding path d in an upside-down state, thus being fed to the secondary transfer device 10. As a result, the secondary transfer of the toner image from the intermediary transfer member 9 onto a second surface of the sheet P is made.

Therefore, similarly as in the case of the one-side image forming mode, the sheet P is fed through a course in the order of the feeding device 14, the fixing device 100, the feeding path b and a discharging roller pair 16, and is discharged, as a full-color image-formed product (resultant product) on which the image is formed on both (first and second) surfaces, onto the discharging tray 17 by the discharging roller pair 16.

(Fixing Device)

Figure 1:
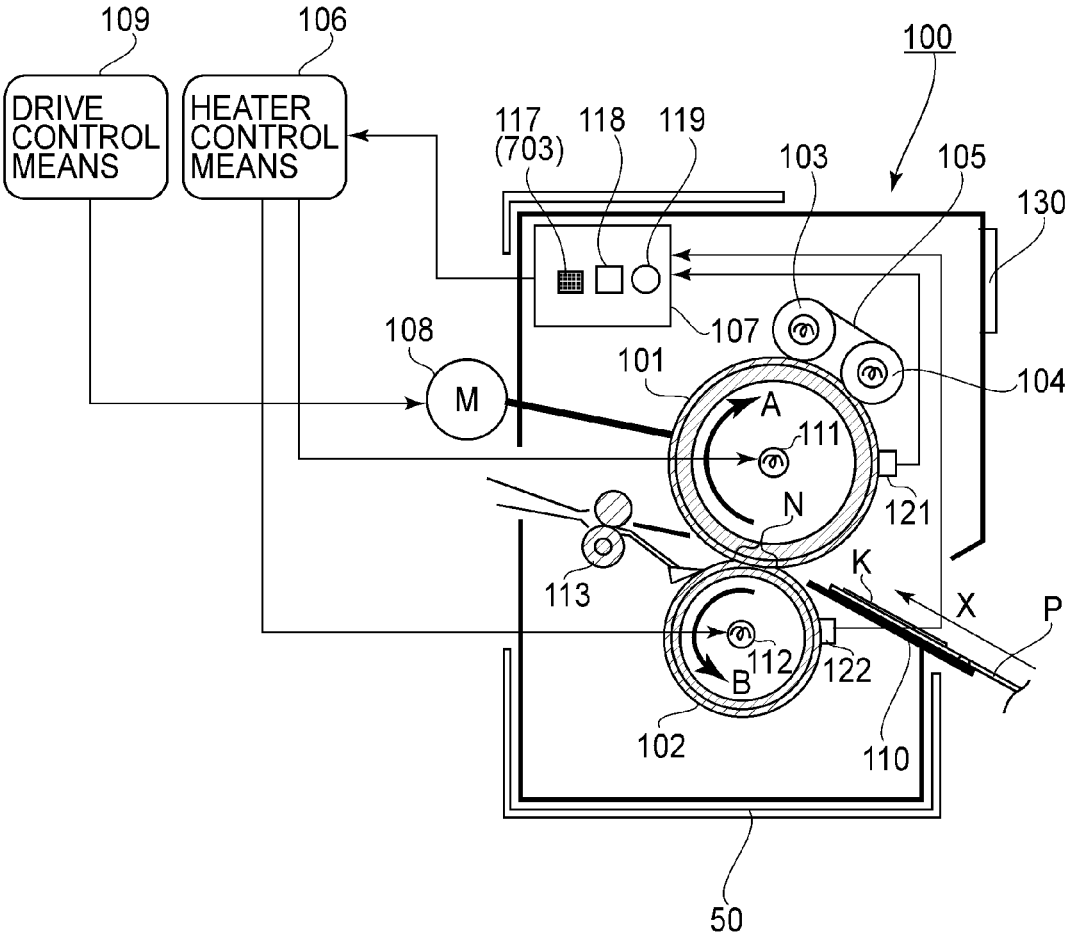
FIG. 1 is a schematic enlarged view of a fixing device.

FIG. 1 is an enlarged schematic view of the fixing device 100 in the image forming apparatus 1 in FIG. 2. The fixing device 100 is detachably mounted as a fixing unit in a mounting portion (fixing device mounting portion) 50 of the apparatus main assembly 1A of the image forming apparatus 1 in a predetermined manner (procedure). In a state, in which the fixing device 100 is mounted so as to be positioned and fixed to the mounting portion 50 of the apparatus main assembly 1A of the image forming apparatus 1 in a predetermined manner, the fixing device is electrically and mechanically connected with a controller, an electric power supplying portion, a driving mechanism portion and the like in the apparatus main assembly 1A side in a predetermined manner, thus receiving supplied electric power and a driving force from the apparatus main assembly 1A side.

The fixing device 100 includes a fixing roller (fixing member) 101 and a pressing roller (opposite member, pressing member) 102, are a pair of rotatable members for forming a nip (fixing nip) N where the sheet P carrying thereon an unfixed toner image K is nipped and fed. Further, the fixing device 100 includes, as an external heating means, an external heating belt 105 rotatably stretched by first and second supporting rollers 103 and 104. Further, the fixing device 100 includes a web cleaning device for cleaning the surface of the fixing roller 101.

The fixing roller 101 is prepared by forming a parting layer of a heat-resistant resin material on an outer peripheral surface of a metal core and is rotationally driven in the clockwise direction of an arrow A at a predetermined peripheral speed by a driving motor (driving mechanism) 108 controlled with respect to a rotational speed by a drive control means (motor controller) 109. Inside the metal core of the fixing roller 101, a halogen heater 111 as an internal heat generating element is provided, and heats the fixing roller 10 in combination with the external heating belt 105 so that the surface temperature of the fixing roller 101 is a predetermined temperature.

The pressing roller 102 is prepared by forming a heat-resistant elastic layer on an outer peripheral surface of a metal core, and is disposed in parallel to the fixing roller 101. Further, by an unshown pressing means, the pressing roller 102 is pressed toward the fixing roller 101 at a predetermined pressure against the elasticity of the elastic layer, so that the fixing nip N having a predetermined width with respect to the feeding direction X of the sheet P is formed between itself and the fixing roller 101.

The pressing roller 102 is rotated by the rotational drive of the fixing roller 101 in the counterclockwise direction of an arrow B at a peripheral speed corresponding to the peripheral speed of the fixing roller 101. Inside the metal core of the pressing roller 102, a halogen heater 112 as the heat generating element is provided, so that the pressing roller 102 is heated from an inside thereof so that the surface temperature of the pressing roller 102 is a predetermined temperature.

The surface temperature of the fixing roller 101 is detected by a thermistor 121 as a temperature detecting means contacting the fixing roller 101. The surface temperature of the pressing roller 102 is detected by a thermistor 122 contacting the pressing roller 102. Electrical signals relating to the temperatures outputted from the thermistors 121 and 122 are once collected by a fixing device substrate (electrostatic circuit substrate) 107 provided in the fixing device 100, and thereafter are inputted into a heater control means 106 functioning as a temperature control (adjusting) means.

The heater control means 106 turns on and off the respective halogen heaters 111 and 112 on the basis of detected temperatures of the thermistors 121 and 122, respectively, so that the heater control means 106 controls the heaters so that each of the surface temperature of the fixing roller 101 and the surface temperature of the pressing roller 102 is the predetermined temperature.

The fixing device substrate 107 also has the following functions in addition to the temperature detection of the thermistors 121 and 122. That is, the fixing device substrate 107 also has the function of controlling driving of a motor for operating an unshown pressing means for moving the pressing roller 102 toward and away from the fixing roller 101 and the function of collecting signal lines and power lines which are used for operating a sensor for detecting positions (pressing state position and pressing-eliminated state position) of the pressing means.

The rotational driving of the fixing roller 101 and the following rotation of the pressing roller 102 with the rotational driving of the fixing roller 101 are performed, and the surface temperatures of both of the rollers are increased up to the predetermined temperatures, so that temperature control is performed. In this fixing device state, the sheet P, which passed through the secondary transfer device 10 and which is fed into the fixing device 100 by the feeding device 14, is guided by a guiding member 110 into the nip N, and is nipped and fed. A carrying surface of the sheet P, which is to be guided into the nip N and which carries the unfixed toner image K, is directed upward, and faces the fixing roller 101.

In this way, by nipping and feeding the sheet P through the nip N, the unfixed toner image K is fixed as the fixed image on the surface of the sheet (recording material) P under application of heat and pressure. The sheet P coming-out of the nip N is separated from the fixing roller 101 and the pressing roller 102, and is sent from the inside of the fixing device 100 by a discharging roller pair 113 for the fixing device 100. The web cleaning device wipes and removes offset toner on the surface of the fixing roller 101. The external heating means (103, 104, 105) is provided upstream of the nip N and downstream of the web cleaning device 114 with respect to the fixing roller rotational direction.

As described above, the fixing device (fixing unit) 100 includes the fixing portions 101 and 102 for fixing the toner image formed on the sheet.

Further, in this embodiment, on the substrate 107 of the fixing device 100, a holding portion 117 for holding information (information relating to an operating condition) for limiting use of the fixing device 100 is mounted. In this embodiment, this holding portion 117 is a nonvolatile memory (storing portion) represented by ROM, RAM, flash memory, or the like.

Specifically, the above information is information corresponding to a specific width of the recording material capable of being introduced into the fixing device, and the information is stored (held) in a size storing region 703 of the memory 117. That is, in the size storing region 703, for a user who requires a high level of uniformity in glossiness of the image, specific width information of the recording material, depending on the user's demand (requirement), is stored. This specific width is a dimension of the recording material with respect to a direction perpendicular to the feeding direction X and is hereinafter referred to as an exclusive width. That is, for such a user, in principle, it becomes possible to provide a fixing device exclusively for the recording material having the specific width.

Accordingly, the fixing device mounted in the image forming apparatus 1 can be replaced with the fixing device for the width of the specific recording material to be subjected to the image formation. That is, the user possesses a plurality of fixing devices (to which the specifications are common) at the same time.

Further, on these fixing devices 100, at a position which is readily recognized by the user (operator), a discriminating member 130, having a visible label (writing) indicating a specific width (W) corresponding to information stored in the memory 117, also be provided.

Further, writing of the above information into the memory 117 may also be performed through a display portion (touch panel) 701A described later. In this case, the writing of the above information into the memory 117 may only be required to be performed after the fixing device mounted in the image forming apparatus is replaced with an unused fixing device 100 and before the image formation is effected.

In the case where the user or the operator intends to completely avoid generation of uneven glossiness of the image due to edge damage, which can occur on the surface of the fixing roller 101, from the plurality of these fixing devices 100, the fixing device 100 for the sheet (exclusive width setting) having the specific width in order to limit the use of the fixing device is selected.

The selection can be made after seeing the label (writing) of the discriminating member 130. Then, the selected fixing device 100 can be used after the mounted fixing device 100 is exchanged (replaced) with the selected fixing device 100 and is mounted in the mounting portion 50 of the apparatus main assembly 1A. As a result, it becomes possible to reliably prevent the generation of an image defect due to the edge damage.

Figure 3:
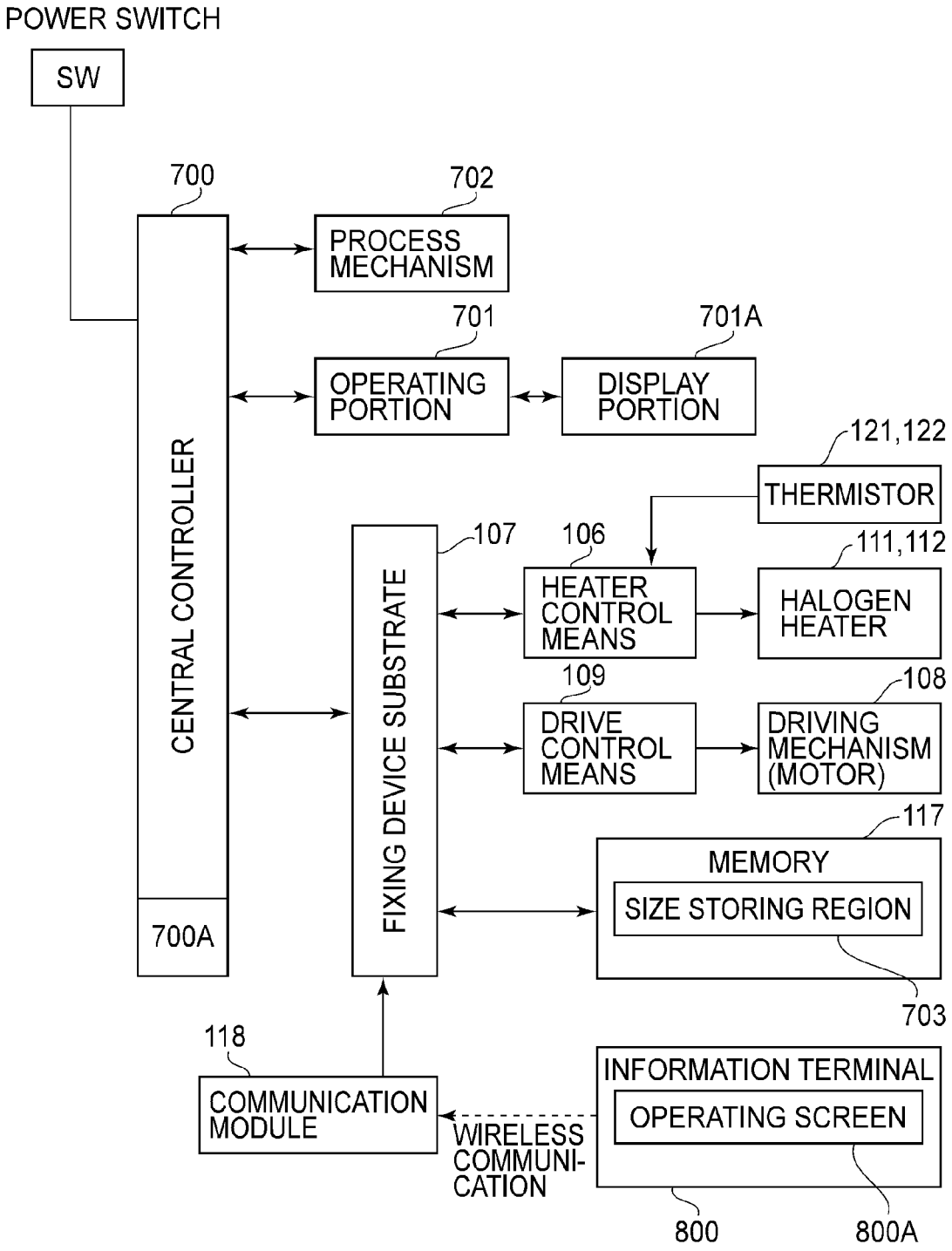
FIG. 3 is a block diagram of an outline of a control system.

FIG. 3 is a block diagram of an outline of a control system of the image forming apparatus 1. A general printing operation (image forming operation) of an image forming process mechanism 702 of the image forming apparatus 1 is controlled by a central controller 700 controlled by a CPU.

Figure 5:
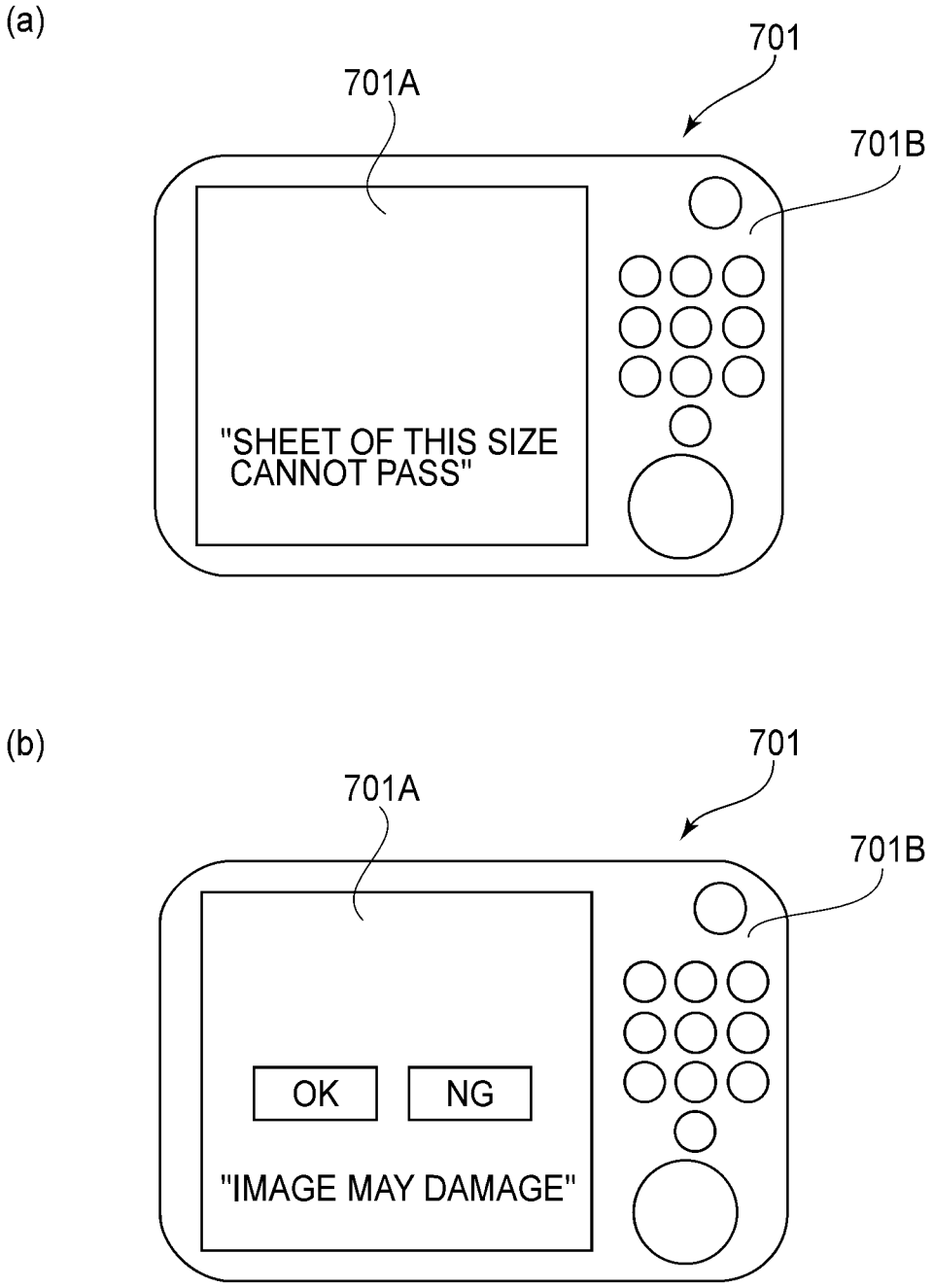
In FIG. 5, (a) and (b) are illustrations each showing an information display of an operating portion.

An operating portion (operating panel) 701 functions as an inputting means, for inputting various pieces of information, such as a recording material size inputting means. The operating portion 701 includes a display portion (information display portion) 701A and an operating button portion 701B as shown in FIG. 5. At the operating button portion 701B, various settings of the printing operation performed by the image forming apparatus 1 are inputted. The display portion 701A is a liquid crystal screen of a touch panel type, and at the display portion 701A, not only is information display of various messages or the like performed, but also display of various operation buttons (keys) is performed. Also by the displayed operation buttons, the various settings of the printing operation performed by the image forming apparatus 1 are inputted.

The fixing device substrate 107 is in an electrically connected state with the controller 700 of the apparatus main assembly 1A side in a state in which the fixing device 100 is mounted in the mounting portion 50 of the apparatus main assembly 1 in a predetermined manner. Further, an information reading function portion (reading portion, obtaining portion) 700A of the controller 700 can read stored information from the memory (storing portion) 117 of the fixing device substrate 107. In this embodiment, the information is stored (held) in the size storing region 703 of the memory 117 in advance. That is, as information relating to an operating condition of the fixing device, it is possible to read information corresponding to the specific width of the sheet to be subjected to the image formation.

Figure 4:
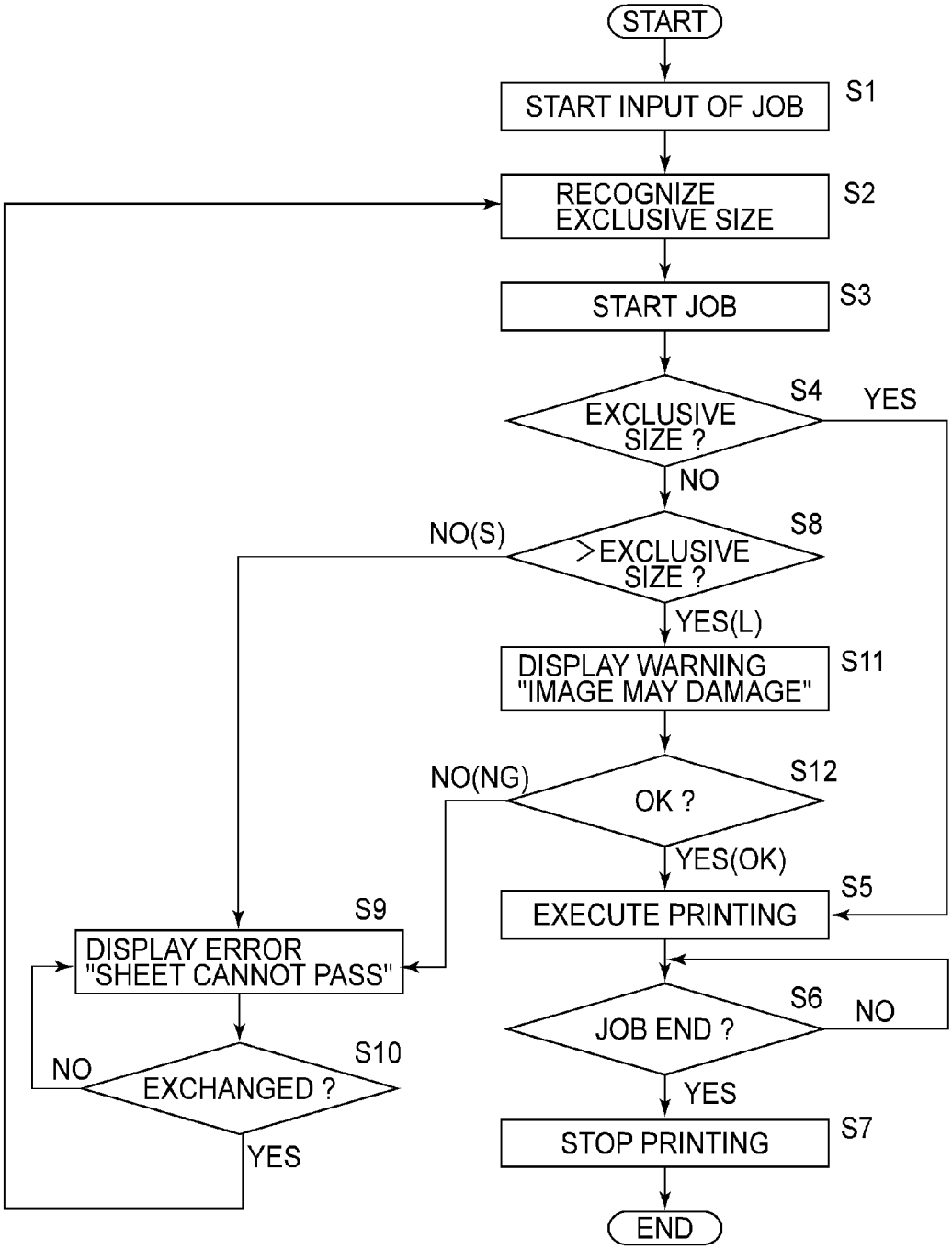
FIG. 4 is a control flowchart.

FIG. 4 is a flowchart of the control effected by the controller 700 in the case where a print job is inputted. When the user starts an inputting operation of the print job contents through the operating portion 701 (S1), the information reading function portion 700A of the controller 700 detects (recognizes) the exclusive width W of the sheet stored in the size storing region 703 of the fixing device substrate 107 of the fixing device 100 currently mounted in the mounting portion 50 of the apparatus main assembly 1A (S2). This detection of the exclusive width W can also be performed when a (main) power switch SW (FIG. 3) of the image forming apparatus 1 is turned on.

The controller 700 can also have a program constituted so that exclusive width information of the fixing device 100 detected by the information reading function portion 700A is displayed at the display portion 701A of the operating portion 701.

By the user, the input of the print job contents advances, so that the basis weight, the size, the number of sheets, and the like, of the sheet P used are designated (printing setting), and thus the job is started (S3). At this time, the controller (also having the function of the obtaining portion) 700 makes reference to the exclusive width W detected in the step S2, and checks whether or not a width W2 of the sheet P designated by the printing setting (print job contents) in the step S3 coincides with the exclusive width W (S4). Then, in the case where the width W2 and the exclusive width W coincide with each other, the controller 700 performs a printing operation in accordance with the inputted print job contents (S5), and when the job is completed, the controller 700 stops the printing operation (S6, S7).

On the other hand, in the case where the width W2 does not coincide with the exclusive width W in the step S4, the controller 700 discriminates whether the width W2 is larger or smaller than the exclusive width W (S8). In the case where the width W2 is smaller than the exclusive width W, an error message saying "SHEET OF THIS SIZE CANNOT PASS", as shown in (a) of FIG. 5, is displayed at the display portion 701A of the operating portion 701 (S9). That is, the image forming operation is prohibited, and replacement and mounting of the fixing device is prompted at the display portion 701A.

After the display of the error, the controller 700 maintains the image forming apparatus 1 in a stand-by state. The user performs a replacing operation, on the basis of the above-described error message, in which the fixing device 100 currently mounted in the apparatus main assembly 1A is exchanged with the fixing device 100, for which the exclusive width W corresponding to the width W2 of the sheet for use was inputted in the step S1, and then is mounted in the apparatus main assembly a1 (S10). When the fixing device 100 is exchanged, the sequence goes back to the step S2, and the exclusive width W stored in the size storing region 703 of the fixing device 100 is detected, and then the controller 700 executes again the above-described control steps.

On the other hand, in the step S8, in the case where the width W2 of the sheet is larger than the exclusive width W, the controller 700 displays a warning "IMAGE MAY DAMAGE" as shown in (b) of FIG. 5 at the display portion 701A of the operating portion 701 (S11). Further, together with the display of this warning, selection buttons (keys) of "OK" (key for permitting the image forming operation) and "NG" (key for not permitting the image forming operation) are displayed on the display portion (touch panel) 701A of the operating portion 701 to seek a user's determination (selection) (S12).

In the case where the user selects "OK" (input of information of permission), the controller 700 executes the printing operation in accordance with the print job contents inputted in the step S1 (S5), and when the job is completed, the printing operation is stopped (S6, S7). On the other hand, when the user selects "NG" (input of information of non-permission), the sequence goes to the step S9, and the error message saying "SHEET OF THIS SIZE CANNOT PASS" as shown in (a) of FIG. 5 is displayed at the display portion 701A of the operating portion 701.

Then, the controller displays, at the display portion, a message prompting exchange to the fixing device 100 in which the width W, which coincides with the width W2 of the sheet obtained in the step S1, is stored in the memory 117. During the period (period until the replacement of the fixing device is performed), the image forming apparatus 1 is maintained in a stand-by state (S10).

The specific width of the sheet stored in the size storing region 703, i.e., the exclusive width W, may also have a certain range, not one certain value. For example, in the case where the width of the sheet P intended to be exclusively used is W1, the width of the sheet designated by printing setting is W2, and a region width in which the image formation of the sheet P is not effected is W3 (a width of a non-image forming region at each of both side portions of an image forming region with respect to the width direction of the sheet), if $W1 \leq W2 \leq W1+2 \times W3$ is satisfied, even when the sheet P having the width W2 designated by the printing setting is passed, there is no problem of edge damage due to the width W1 of the sheet P intended to be exclusively passed, since the region corresponds to the non-image forming region of the sheet P provided by the print job. Accordingly, in discrimination in the step S4 in FIG. 4, satisfaction of W1≤W2≤W1+2×W3 by the width W2 provided by the print job may also be used as a criterion of the discrimination that the widths coincide with each other in the step S4.

An effect of carrying out this embodiment will be described with reference to FIG. 6. In the case where sheets having the same width as the exclusive width W set for the fixing device 100 are passed, as shown in (a) of FIG. 6, edge damage 101*a* continuously extending in a circumferential direction of the fixing roller 101 is generated at positions corresponding to the exclusive width W on the surface of the fixing roller 101. This phenomenon is similarly generated on the surface of the pressing roller 102, and therefore, a discussion thereof will be omitted. Y is a center (line)-basis feeding line (phantom line) of the sheet P.

Figure 6:
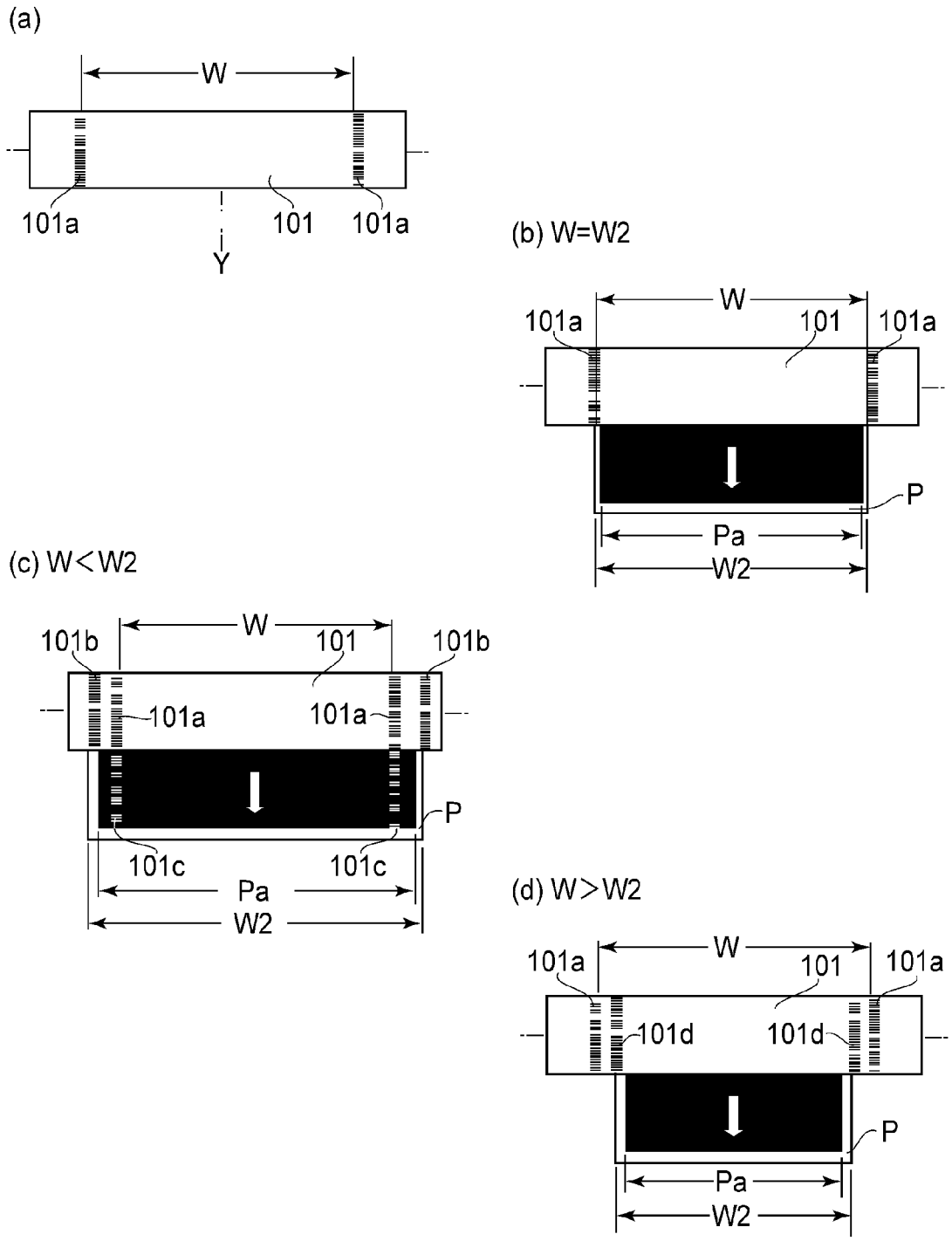
In FIG. 6, (a) to (d) are relational views each showing a relationship between edge damage of a fixing roller and a recording material.

In a state in which such edge damage 101*a* is generated on the surface of the fixing roller 101, as shown in (b) of FIG. 6, the case where the sheet P having the width W2 equal to the exclusive width W (W=W2) set for the fixing device 100 will be considered. In this case, the edge damage 101*a* of the fixing roller 101 is positioned outside an image forming region width Pa of the sheet P. Accordingly, in an image forming region of the sheet P, an image defect due to transfer of the edge damage 101*a* of the fixing roller 101 is not generated. An open (hollow) arrow represents the feeding direction of the sheet P.

Further, on the fixing roller 101 or the pressing roller 102, the edge damage 101*a* (102*a*) is generated only at the positions of the width W, and therefore there is no influence on the sheet P, having the width W2 corresponding to the exclusive width W, to be passed thereafter.

In FIG. 6, (c) shows the case where the width W2 of the sheet P designated by the printing setting is larger than the exclusive width W set for the fixing device 100 (W<W2). In this case, in the image forming region of the sheet P, there is a possibility that an image defect 101*b* due to transfer of the edge damage 101*a* is generated at positions corresponding to the exclusive width W on the surface of the fixing roller 101. In such a case, as in the step S11 in FIG. 4, in the case where the generation of the damage 101*b* on the image can be permitted by obtaining confirmation by the user, passing of the sheet P having the width W2 larger than the exclusive width W is permitted.

At this time, on the fixing roller 101 on the pressing roller 102, as shown in (c) of FIG. 6, edge damage 101*c* can be generated within the width W2. However, as shown in (b) of FIG. 6, when the sheet P having the width W2 corresponding to the exclusive width W (W=W2) set for the fixing device 100 is passed, the image defect due to the edge damage 101*a* or 101*b* is not generated in the image forming region Pa. For that reason, there is no influence on a desired sheet P to be passed thereafter.

Next, as shown in (d) of FIG. 6, the case where the width W2 of the sheet P designated by the printing setting is smaller than the exclusive width W (W>W2) set for the fixing device 100 will be considered. In this case, in the image forming region of the sheet P, the image defect due to the edge damage 101*a* is not generated.

However, in the case where this sheet is passed, edge damage 101*d* can be generated at positions of the width W2 on the fixing roller 101 or the pressing roller 102. That is, when the sheet P having the width corresponding to the exclusive width W set for the fixing device 100 is passed thereafter, there is a possibility that the image defect due to the edge damage 101*d* is generated at the positions of the width W2 in the image forming region of the sheet P.

Therefore, in this embodiment, in the case where the width W2 of the sheet P designated by the printing setting is smaller than the exclusive width W (W>W2) set for the fixing device 100, the error is displayed as in the step S9 of FIG. 4, so that execution of the print job is prohibited.

As described above, a plurality of fixing devices 100 having setting of the exclusive width for each of sizes (widths) of the sheets P used in the image forming apparatus 1 are prepared. Then, the exclusive width set for the fixing device 100 mounted in the image forming apparatus 1 is recognized, and control is made so that only the sheet having the width corresponding to the exclusive width W can pass through the fixing device 100.

As a result, it is possible to prevent passing of the sheet, having the width other than the width corresponding to the exclusive width set for the fixing device 100, caused by an error in fixing device 100 to be replaced and mounted in the apparatus main assembly 1A or by an erroneous operation of the user. For that reason, it is possible to prevent the generation of the image defect due to the edge damage, on the surface of the fixing roller 101, within the image forming region Pa of the sheet P.

Further, in the case where the width W2 of the sheet P designated in the printing setting by the user is larger than the exclusive width W (W<W2) set for the fixing device 100, the warning that there is a possibility of the generation of damage on the image is made and then a determination of the user is sought. For example, in the case where such a resultant product that image damage is not conspicuous or the user does not worry about the image damage is intended to be outputted, it becomes possible to effect the sheet passing without exchanging the fixing device 100. Accordingly, it becomes possible to execute such printing with no waiting time.

Incidentally, e.g., in the case where plain paper low in glossiness is used as the sheet P and a text document is printed, even when the edge damage is generated on the fixing roller 101, the image defect due to the edge damage is hardly recognizable on the fixed image. For this reason, in the case where the size information is not stored in the size storing region 703, it is also possible to pass the sheets P having all the widths through the fixing device 100.

The constitution of the image forming apparatus 1 described above is summarized as follows. The image forming apparatus 1 includes the image forming apparatus main assembly 1A including the fixing device mounting portion 50 and includes the fixing device 100 detachably mountable to the fixing device mounting portion 50. Further, the image forming apparatus 1 includes the holding (storing) means 117, provided in the fixing device 100, capable of holding (storing) the information relating to the operating condition of the fixing device by setting or setting change of the information. Further, the image forming apparatus 1 includes the discriminating means 700A for discriminating the information held in the holding means 117 in the state in which the fixing device 100 is mounted in the fixing device mounting portion 50, and includes the controller 700 for controlling the image forming operation of the image forming apparatus on the basis of a discrimination result of the discriminating means 700A.

The information is a size of the sheet capable of being introduced into the fixing device. The holding portion 117 is a memory.

(Setting Method of Sheet Size Information)

Next, a method of setting sheet size information or changing the setting (of the sheet size information) in the size storing region 703 of the memory 117 as the holding portion (storing portion) provided in the fixing device 100 will be described.

In a state in which the fixing device 100 is mounted in the image forming apparatus 1, in the case where the sheet size information is set in the memory 117 or the setting is changed, the setting or the setting change can be made using the operating portion 701.

Figure 7:
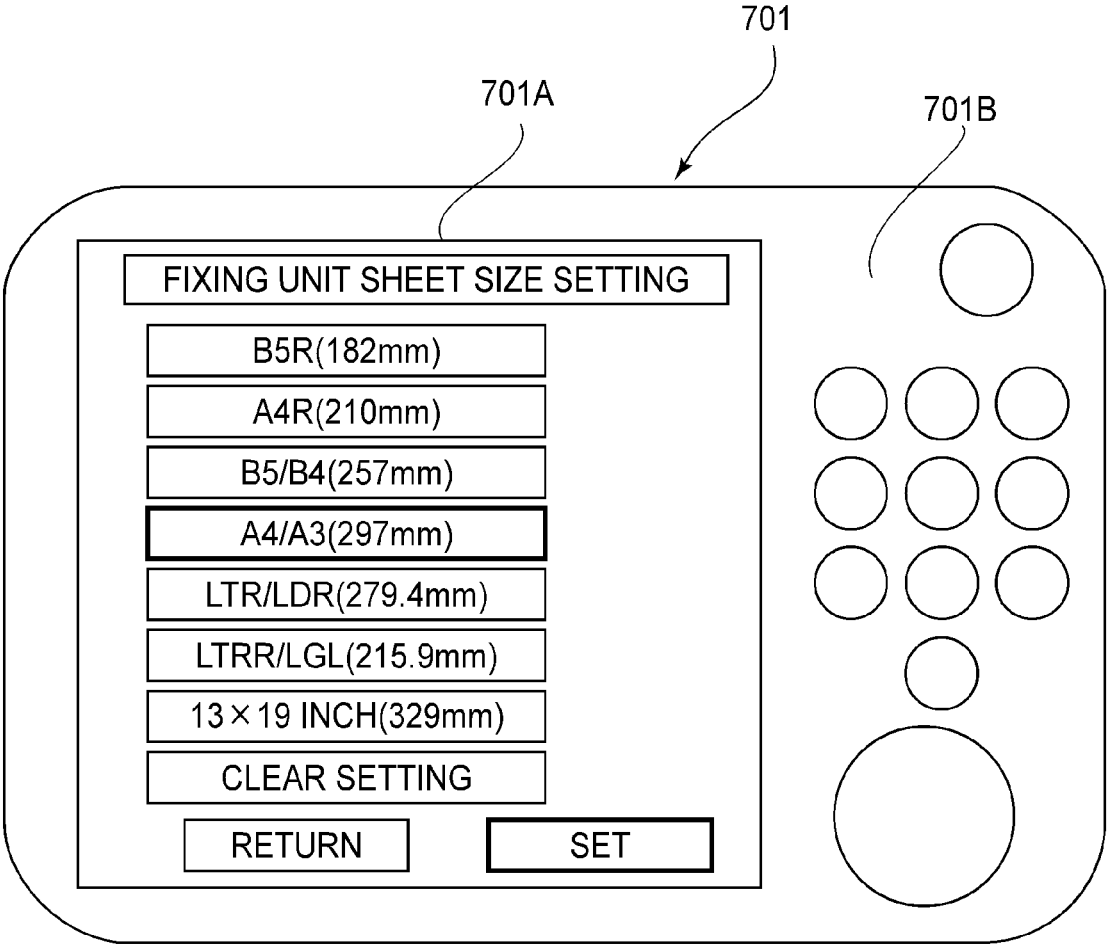
FIG. 7 illustrates a sheet width setting screen displayed at a display portion of an operating portion.

That is, the operating portion 701 is controlled by the controller so that a sheet width setting screen can be displayed as shown in FIG. 7 by a screen selecting operation at the display portion 701A of the operating portion 701. Then, by using this screen, it becomes possible to set the exclusive width or change the setting of the exclusive width, through the operating portion 701, in the size storing region 703 of the memory 117 in the fixing device 100 mounted in the mounting portion 50 of the apparatus main assembly 1A.

In the sheet width setting screen, a button of, e.g., "A4/A3 width (297 mm)" size is pushed, and then a button of "SET" is pushed. As a result, a set value of the A4/A3 width (297 mm) size as the exclusive width is written by the controller 700 in the size storing region 703 of the memory 117 of the fixing device 100 currently mounted in the apparatus main assembly 1A.

By this writing, the fixing device 100 is discriminated, in the state in which the fixing device 100 is mounted in the mounting portion 50 of the apparatus main assembly 1A, as a fixing device exclusively used for the A4/A3 width by the discriminating means 700A of the controller 700. The sheet size information written in the size storing region 703 is written data, and therefore is retained even when the fixing device 100 is demounted from the apparatus main assembly 1A.

Further, at a lower portion of the sheet width setting screen, a button of "CLEAR SETTING (OF SHEET WIDTH)" is displayed in parallel to other buttons, and therefore when this setting is made, the value of the size storing region 703 is cleaned to be returned to a value in a state of factory shipment.

As described above, the image forming apparatus includes the operating portion 701 where an operator is capable of inputting information for limiting the width of the recording material subjected to the image formation. Further, the image forming apparatus includes an updating portion (CPU) 700 for updating the information stored in the storing portion 117 depending on the information inputted through the operating portion 701. As described above, the size storing region of the memory 117 of the fixing device 100 is set as a data storing region in which data is arbitrarily set changeably through the operating portion 701 by the user.

On the other hand, the change in exclusive width setting for the fixing device 100 can cause a problem of the image defect due to the edge damage when the change is not made simultaneously with the exchange of the fixing device with a new one. For that reason, the change in exclusive width setting is required to be made before the new fixing device is mounted in the apparatus main assembly 1A of the image forming apparatus 1.

The exclusive width setting in this case was made through, e.g., wireless communication. The fixing device substrate 107 in this embodiment includes, as shown in FIG. 1, a battery (accumulator) 119 and a communication module (receiving portion) 118 of a Bluetooth (registered trademark). For the exclusive width setting, a portable (mobile) information terminal (external terminal) 800 (FIG. 3) in which an exclusive managing software is installed is used. On an operating screen 800A of the portable information terminal 800, a setting screen similar to the sheet width setting screen (FIG. 7) displayed at the display portion 701A of the operating portion 701 of the image forming apparatus 1 is displayed, and writing of sheet size information set in the size storing region 703 through the wireless communication is made.

The constitution of the above-mentioned fixing unit (fixing device) 100 is summarized as follows. The fixing unit 100 is detachably mountable to the image forming apparatus. The fixing unit 100 includes the fixing portions 101 and 102 for fixing the toner image, formed on the recording material, when the fixing unit 100 is mounted in the image forming apparatus, and includes the rotating portion 118 capable of rotating signals from the external terminal 800 when the fixing unit 100 is demounted from the image forming apparatus. Further, the fixing unit 100 includes the storing portion 117 for storing the information, readable by the image forming apparatus, for limiting the width of the recording material to be fixed depending on the signal received by the receiving portion 118.

Further, the fixing unit 100 includes the accumulator 119 for driving the receiving portion 118 and the storing portion 117 when the fixing unit 100 is demounted from the image forming apparatus. The receiving portion 118 is capable of receiving wireless signals sent from the external terminal 118.

Incidentally, in the case where setting or rewriting of the sheet size information for the fixing device 100 is made in the above-described manner, for writing of the discriminating member 130 (FIG. 1), it is preferable that an operation for providing writing corresponding to the set or rewritten sheet size information is performed.

The sheet size information written in the size storing region 703 is read by the information reading function portion 700A of the controller 700 in the case where the power switch SW of the image forming apparatus 1 in which the fixing device 100 is mounted is turned on. Or, the sheet size information is read by the information reading function portion 700A when an inputting operation of the print job contents is started by the user. Further, the sheet size information is read by the information reading function portion 700A in the case where the fixing device 100 is demounted from the image forming apparatus 1 and then is mounted again in the image forming apparatus 1 for maintenance or the like. That is, the image forming apparatus includes the reading portion 700A for reading the information stored in the above-mentioned storing portion 117 of the fixing device 100.

Figure 8:
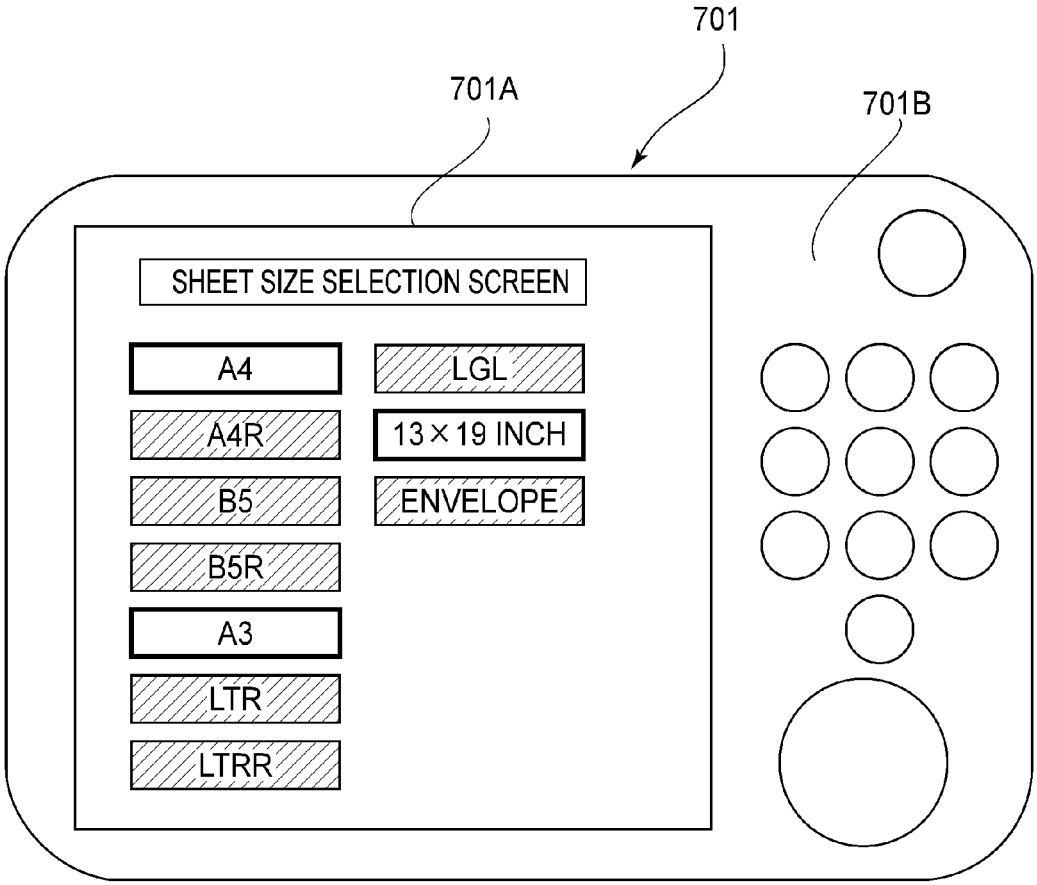
FIG. 8 illustrates a sheet width selection screen displayed at the display portion of the operating portion.

FIG. 8 is an illustration showing a sheet size selection screen when the fixing device 100 for which the exclusive width is set is mounted in the mounting portion 50 of the apparatus main assembly 1A. In an example of FIG. 8, the case where the fixing device 100 for which the A4/A3 width (297 mm) size is set is mounted is shown. The exclusive width for the fixing device 100 is set at the A4/A3 width (297 mm), and therefore selection of a part of the sheet sizes is disabled. That is, in the screen in which the size of the sheet P set in the image forming apparatus 1 is selected, buttons for setting sizes smaller in sheet width than 297 mm are greyed out, so that the screen is controlled by the controller so that these buttons cannot be selected.

That is, the image forming apparatus includes a limiting portion (CPU) 700 for limiting the width, of the recording material to be subjected to the image formation, depending on the information read by the reading portion 700A. In this way, in the case where the plurality of the fixing devices 100 different in exclusive width setting are used in the image forming apparatus 1 in a replacing manner, control corresponding to the set sheet size is effected, so that it is possible to prevent transfer of the edge damage onto the fixed image with reliability.

Or, in the case the fixing device 100 is replaced with a fixing device in another image forming apparatus 1 and then is used, control corresponding to the set sheet size is effected, so that it is possible to prevent transfer of the edge damage onto the fixed image with reliability.

In the state in which the fixing device 100 is demounted from the image forming apparatus 1, the sheet size setting can be rewritten, and therefore the user can make flexible setting change so as to meet user's needs of use.

Figure 9:
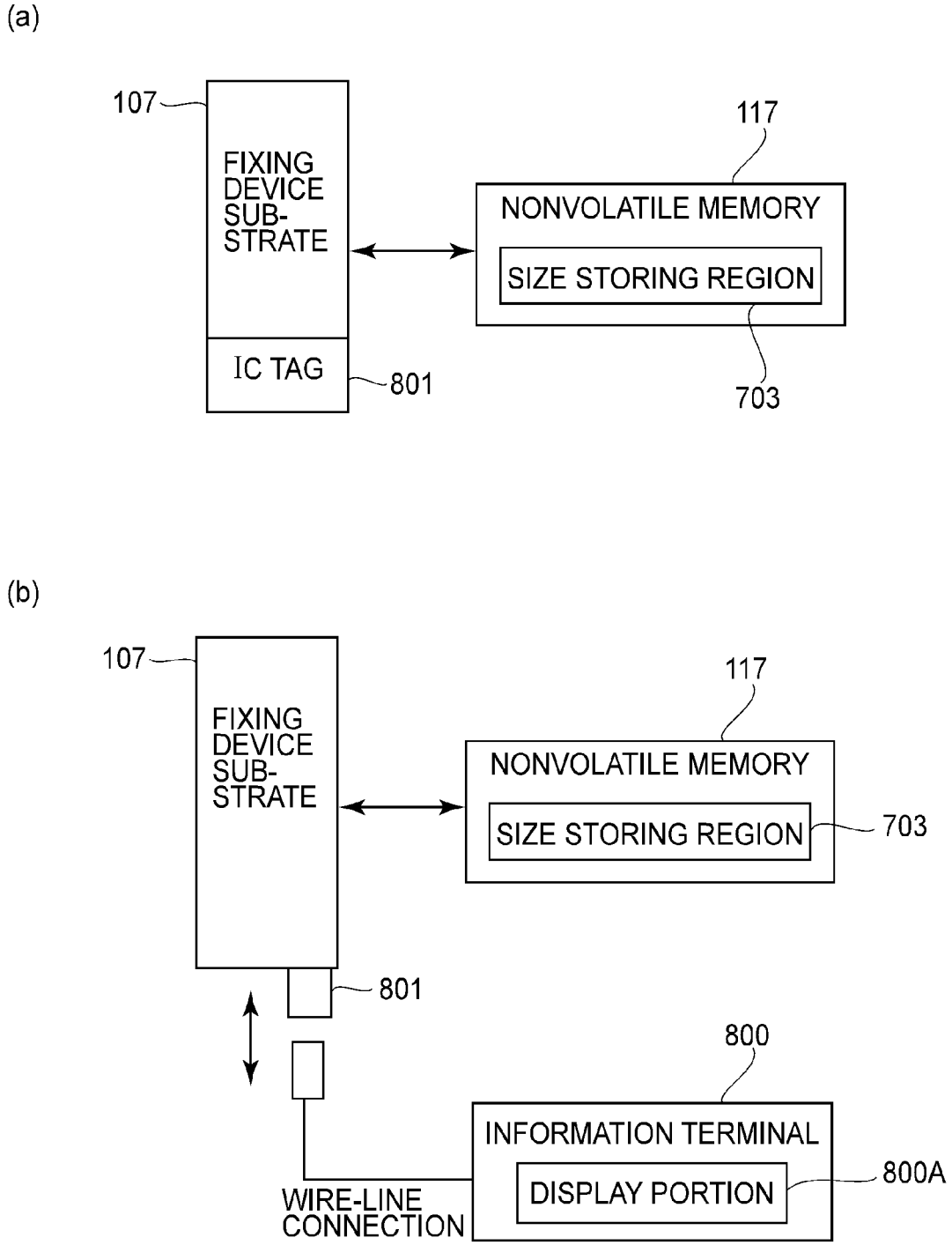
In FIG. 9, (a) and (b) are illustrations each showing a constitution of another means for setting an exclusive sheet width for the fixing device.

In this embodiment, the wireless communication system used for setting or setting change of the exclusive width for the fixing device 100 is an example. As shown in (a) of FIG. 9, a constitution in which an IC tag (RFID) 801 which does not require the battery 119 is provided on the fixing device substrate 107 and in which writing (rewriting) of recorded exclusive width setting is made may also be employed. Further, as shown in (b) of FIG. 9, a constitution in which a connector 802 of a USB type or the like is provided on the fixing device substrate 107 and electric power is supplied from the portable information terminal (external terminal) 800 connected via a line (cable) with the connector 800 and in which writing (rewriting) of the exclusive width setting recorded in the memory 117 is made may also be employed.

As described above, in the image forming apparatus in this embodiment of the type in which the fixing device is replaced, the memory is mounted in the fixing device in order to limit the sheet size introduced into the fixing device. Then, in a stage before the fixing device is mounted in the image forming apparatus, it is possible to limit a use of the fixing device by using the external terminal. Accordingly, a user possessing a plurality of fixing devices to which the specifications are common can impose limitation of use no a desired sheet size at convenient timing. That is, flexible operation is enabled correspondingly to the user's needs, and it becomes possible to prevent the generation of the image defect with reliability.

As described above, the above-mentioned Embodiments were described as applied embodiments of the present invention, but various constitutions can be replaced with other known constitutions within the scope of the concept of the present invention.

For example, the image forming apparatus is not limited to the color image forming apparatus, but may also be a monochromatic (single color) image forming apparatus for a monochromatic image or the like.

For example, the fixing device 100 is not limited to a device for heating and fixing the unfixed image formed on the recording material. Also a device used in a process for adjusting a surface glossiness of an image by re-heating the toner image which has already been partly fixed or fully fixed (also in this case, the device will be referred to as the fixing device) is embraced in the fixing device 100.

For example, the fixing device 100 can also have a device constitution using an endless belt having flexibility as either one or both of the fixing member 101 and the opposite member 102. The opposite member 102 can also have a device constitution in which a non-rotatable member, such as a pad member or a plate-like member, having a slidable surface which is low in coefficient of friction with the fixing member 101 or the recording material P.

Further, the heating mechanism for the fixing member 101 and the opposite member 102 is not limited to the halogen heater. The heating mechanism can also have a constitution employing other appropriate heating mechanisms such as a ceramic heater type or an electromagnetic induction heating type.

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Applications Nos. 2014-111045 filed on May 29, 2014 and 2015-076665 filed on Apr. 3, 2015, which are hereby incorporated by reference herein in its entirety.

What is claimed is:

1. A fixing device installable in an image forming apparatus, comprising:

a pair of rotatable members forming a nip configured to fix a toner image on a recording material by heat and pressure;

a receiving portion that receives, from an external terminal, information on a width of the recording material for permitting execution of a fixing operation by said fixing device when said fixing device is not installed in the image forming apparatus; and a storing portion configured to store the information received by said receiving portion when said fixing device is not installed in the image forming apparatus.

2. The fixing device according to claim 1, wherein the fixing operation of said fixing device is carried out for the recording material having the same width as that indicated by the information stored in said storing portion, and the fixing operation of said fixing device is not carried out for the recording material having a width smaller than that indicated by the information stored in said storing portion.

3. The fixing device according to claim 1, further comprising an electrical accumulator configured to accumulate electrical energy for activating said receiving portion and said storing portion.

4. The fixing device according to claim 1, wherein said receiving portion is configured to wirelessly receive the information from the external terminal when said fixing device is not installed in the image forming apparatus.

5. The fixing device according to claim 1, wherein the external terminal is a portable terminal.

6. An image forming apparatus comprising:

an image forming portion configured to form an image on a recording material;

a fixing portion configured to fix the image, formed by said image forming portion, on the recording material, wherein said fixing portion includes a receiving portion that receives, from an external terminal, information on a width of the recording material for permitting execution of a fixing operation by said fixing portion when said fixing portion is not installed in said image forming apparatus; and an operating portion, configured to be operated by an operator, that receives information on a width of the recording material for permitting the execution of the fixing operation by said fixing portion when said fixing portion is placed at a fixing position where the fixing operation is executable by said fixing portion in said image forming apparatus, wherein said fixing portion includes a storing portion configured to store the information, wherein said storing portion stores the information inputted to said operating portion when said fixing portion is placed at the fixing position and said storing portion stores the information received by said receiving portion when said fixing portion is not installed in said image forming apparatus.

7. An apparatus according to claim 6, further comprising:

a reading portion configured to read the information stored in said storing portion when said fixing portion is placed at the fixing position in said image forming apparatus; and a controller configured to control whether to prohibit an image forming operation, on the basis of the information read out of said reading portion.

8. An apparatus according to claim 6, further comprising an electrical accumulator configured to accumulate electrical energy for activating said receiving portion and said storing portion.

9. An apparatus according to claim 6, wherein said receiving portion is configured to wirelessly receive the information from the external terminal when said fixing portion is not installed in said image forming apparatus.

10. An apparatus according to claim 6, wherein the external terminal is a portable terminal.

11. An apparatus according to claim 7, wherein said controller permits the image forming operation on the recording material having the same width as that indicated by the information read out of said reading portion, and said controller prohibits the image forming operation on the recording material having a width smaller than that indicated by the information read out of said reading portion.

12. An apparatus according to claim 11, further comprising a display portion, wherein said controller controls said display portion to display a message prompting exchange of said fixing portion when the width of the recording material on which the image is to be formed is smaller than the width of the recording material indicated by the information read out of said reading portion.

13. An apparatus according to claim 12, wherein when the width of the recording material on which the image is to be formed is smaller than the width of the recording material indicated by the information read out of said reading portion, said controller controls said display portion to display a message prompting exchange of said fixing portion provided with the storing portion storing the information corresponding to the width of the recording material which is the same as the width of the recording material on which the image is to be formed.

14. An apparatus according to claim 11, further comprising a display portion, wherein said controller controls said display portion to prompt selection as to whether to permit the image forming operation when the width of the recording material on which the image is to be formed is larger than the width of the recording material indicated by the information read out of said reading portion.

15. An apparatus according to claim 14, wherein when the width of the recording material on which the image is to be formed is larger than the width of the recording material indicated by the information read out of said reading portion, said controller controls said display portion to display on said display portion a key for permitting the image forming operation and a key for not permitting the image forming operation.

16. An apparatus according to claim 7, further comprising a display portion, wherein when the width of the recording material on which the image is to be formed is larger than the width of the recording material indicated by the information read out of said reading portion, said controller controls said display portion to prompt selection as to whether to permit the image forming operation.

17. An apparatus according to claim 16, wherein when the width of the recording material on which the image is to be formed is larger than the width of the recording material indicated by the information read out of said reading portion, said controller controls said display portion to display on said display portion a key for permitting the image forming operation and a key for not permitting the image forming operation.

18. A fixing device installable in an image forming apparatus, comprising:

a pair of rotatable members forming a nip configured to fix a toner image on a recording material by heat and pressure;

a receiving portion that receives, from an external terminal, information on a width of the recording material for permitting execution of a fixing operation by said fixing device when said fixing device is not placed at a fixing position where the fixing operation is executable by said fixing device in the image forming apparatus; and a storing portion configured to store the information received by said receiving portion when said fixing device is not placed at the fixing position in the image forming apparatus.

19. An apparatus according to claim 6, further comprising a pair of rotatable members forming a nip configured to fix the image formed on the recording material by heat and pressure.

20. An image forming apparatus comprising:

an image forming portion configured to form an image on a recording material;

a fixing portion configured to fix the image, formed by said image forming portion, on the recording material; and an operating portion configured to be operated by an operator, that receives information on a width of the recording material for permitting execution of a fixing operation by said fixing portion when said fixing portion is placed at a fixing position where the fixing operation is executable by said fixing portion in said image forming apparatus, wherein said fixing portion includes a receiving portion that receives, from an external terminal, information on a width of the recording material for permitting the execution of the fixing operation by said fixing portion when said fixing portion is not placed at the fixing position, and wherein said fixing portion includes a storing portion configured to store the information, wherein said storing portion stores the information inputted to said operating portion when said fixing portion is placed at the fixing position and said storing portion stores the information received by said receiving portion when said fixing portion is not placed at the fixing position.

21. An image forming apparatus comprising:

an image forming portion configured to form an image on a recording material;

a fixing portion configured to fix the image, formed by said image forming portion, on the recording material, wherein said fixing portion includes a receiving portion that receives information corresponding to a width of the recording material from an external terminal when said fixing portion is not installed in said image forming apparatus;

an operating portion, configured to be operated by an operator, that receives information corresponding to a width of the recording material when said fixing portion is placed at a fixing position where a fixing operation is executable by said fixing portion in said image forming apparatus, wherein said fixing portion includes a storing portion configured to store the information corresponding to the width of the recording material, wherein said storing portion stores the information inputted to said operating portion when said fixing portion is placed at the fixing position and said storing portion stores the information received by said receiving portion when said fixing portion is not installed in said image forming apparatus; and a controller configured to permit an image forming operation on the recording material having the same width as that corresponding to the information stored in said storing portion, and configured to limit the image forming operation on the recording material having a width smaller than that corresponding to the information stored in said storing portion.

22. An apparatus according to claim 21, wherein said storing portion stores the information inputted to said operating portion with input of the information corresponding to the width of the recording material to said operating portion when said fixing portion is placed at the fixing position.

23. An apparatus according to claim 21, wherein said storing portion stores the information received by said receiving portion with reception of the information corresponding to the width of the recording material by said receiving portion when said fixing portion is not installed in said image forming apparatus.

24. An apparatus according to claim 21, further comprising a display portion, wherein said controller controls the display portion to display a message prompting exchange of said fixing portion when the width of the recording material on which the image is to be formed is smaller than that corresponding to the information stored in said storing portion.

25. An apparatus according to claim 24, wherein when the width of the recording material on which the image is to be formed is smaller than that corresponding to the information stored in said storing portion, said controller controls the display portion to display a message prompting exchange of said fixing portion provided with the storing portion storing the information corresponding to the width of the recording material which is the same as the width of the recording material on which the image is to be formed.

26. An apparatus according to claim 21, further comprising a display portion, wherein said controller controls said display portion to prompt selection as to whether to permit the image forming operation when the width of the recording material on which the image is to be formed is larger than that corresponding to the information stored in said storing portion.

27. An apparatus according to claim 26, wherein when the width of the recording material on which the image is to be formed is larger than that corresponding to the information stored in said storing portion, said controller controls the display portion to display a key for permitting the image forming operation and a key for not permitting the image forming operation.

28. An apparatus according to claim 21, further comprising an electrical accumulator configured to accumulate electrical energy for activating said receiving portion and said storing portion.

29. An apparatus according to claim 21, wherein said receiving portion is configured to wirelessly receive the information from the external terminal when said fixing portion is not installed in the image forming apparatus.

30. An apparatus according to claim 21, wherein the external terminal is a portable terminal.

31. An apparatus according to claim 21, further comprising a pair of rotatable members forming a nip configured to fix the image formed on the recording material by heat and pressure.

* * * * *